United States Patent [19]

Jennings

[11] Patent Number: 4,784,288

[45] Date of Patent: Nov. 15, 1988

[54] ARTICLE DISPENSER WITH TAMPER-EVIDENT MEANS

[76] Inventor: Kenneth L. Jennings, Rte. 2, P.O. Box 83-4, Strafford, Mo. 65757

[21] Appl. No.: 914,381

[22] Filed: Oct. 2, 1986

Related U.S. Application Data

[63] Continuation-in-part of Ser. No. 781,040, Sep. 27, 1985, abandoned.

[51] Int. Cl.[4] ..... B65D 83/04

[52] U.S. Cl. ..... 221/4; 215/230; 206/534; 206/807; 206/536

[58] Field of Search ..... 215/230, 313, 365; 221/4, 151, 154; 206/534, 535–537, 807; 220/214

[56] References Cited

U.S. PATENT DOCUMENTS

| | | | |
|---|---|---|---|
| 2,112,125 | 3/1938 | Von Bultzingslonen | 222/522 |
| 2,877,918 | 3/1959 | Gardner | 222/522 |
| 4,083,476 | 4/1978 | Schwartz et al. | 222/498 X |
| 4,458,820 | 7/1984 | Abrams | 215/230 |
| 4,544,063 | 10/1985 | Neward | 220/253 X |

FOREIGN PATENT DOCUMENTS

| | | | |
|---|---|---|---|
| 554861 | 2/1957 | Belgium | 222/499 |

*Primary Examiner*—Charles A. Marmor

*Attorney, Agent, or Firm*—Leonard Tachner

[57] ABSTRACT

An easy-to-open article dispenser preferably made of readily moldable plastic and comprising a container member having a chamber for containing a plurality of articles such as vitamin pills and having a dispenser portion, the article dispenser also comprising a dispenser control member adapted for slideable engagement with the dispenser portion whereby to selectively place a first dispenser aperture in communication with a port or second aperture for opening the dispenser. A plurality of embodiments are disclosed. Some embodiments provide for axial motion and some provide for rotational motion of the dispenser control member relative to the dispenser portion of the container member. A particularly timely improvement relates to a tamper-evident feature which makes it virtually impossible for anyone to tamper with the contents of the dispenser without such tampering being immediately discernible to the user. A rotational motion version of this tamper-resistant feature provides aligned arrows or other indicia when the dispenser control member is first placed onto the dispenser. Only if such indicia are not aligned at the time of purchase, is it possible for someone to have gained unauthorized access to the contents of the dispenser. Only after the indicia alignment is confirmed by the user, does the user place the dispenser in a normal open and close mode of operation.

1 Claim, 8 Drawing Sheets

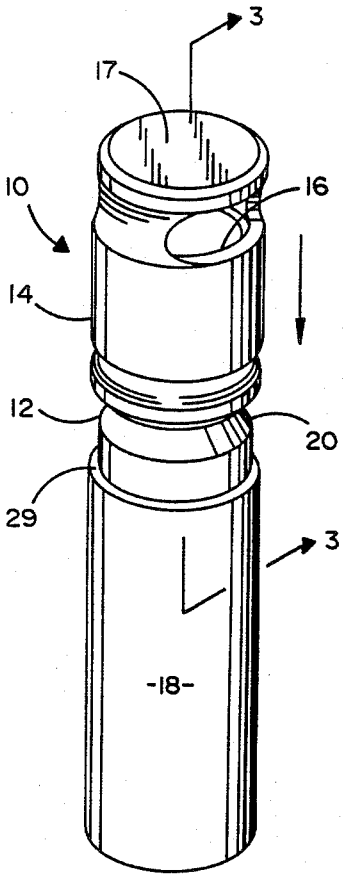
FIG. 1
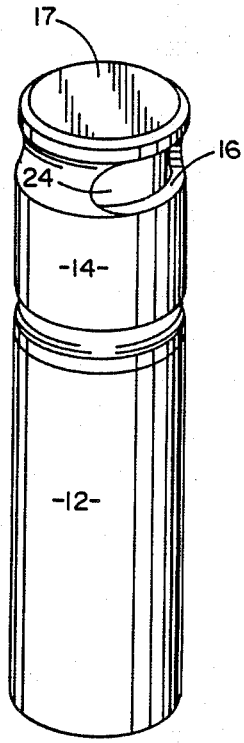
FIG. 2
FIG. 3
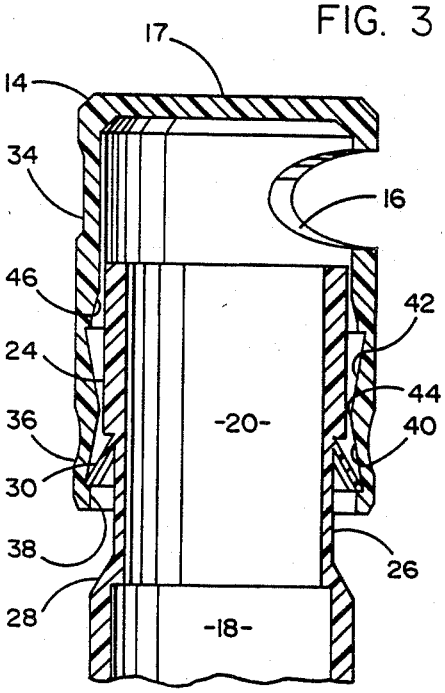
FIG. 4
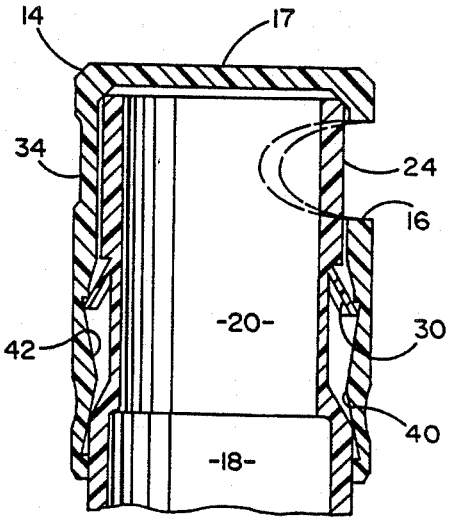

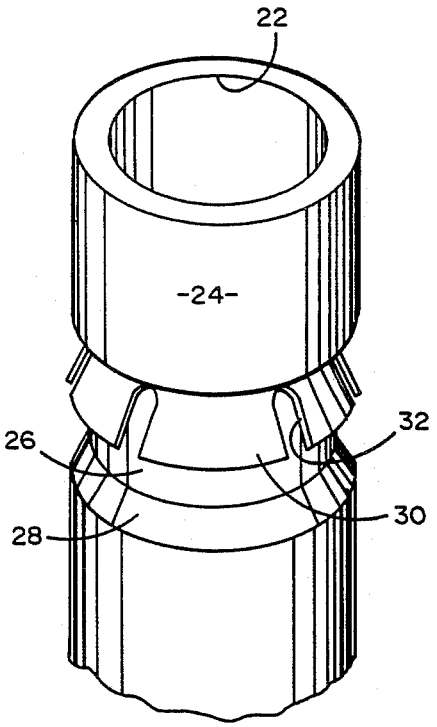
FIG. 5
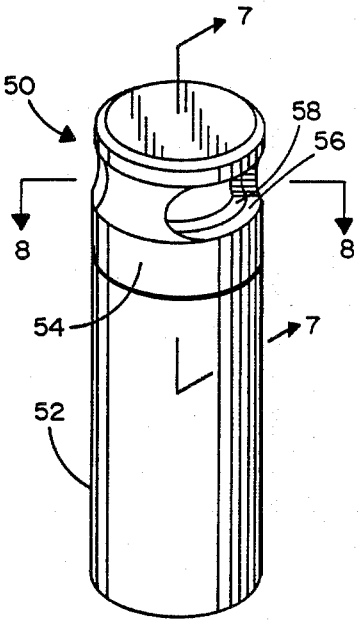
FIG. 6
FIG. 7
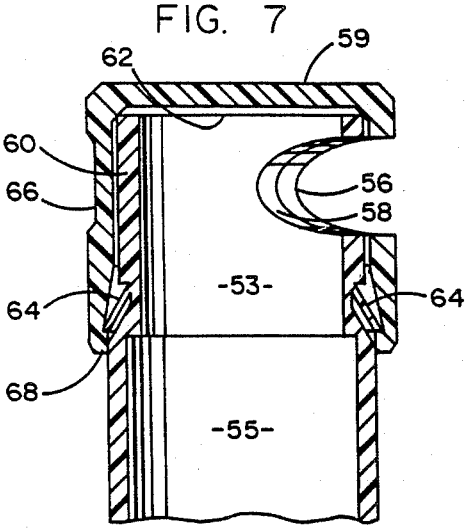
FIG. 8
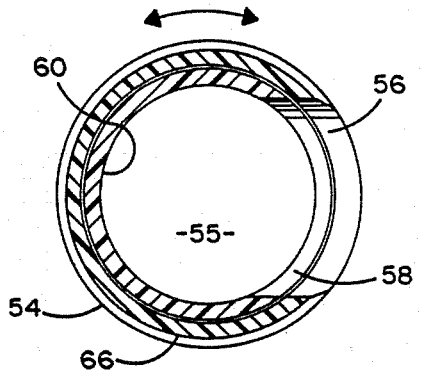

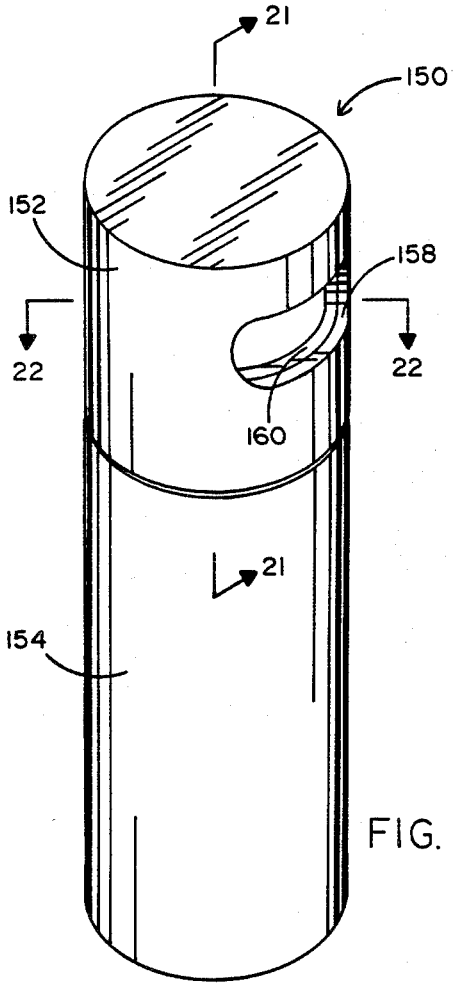
FIG. 19
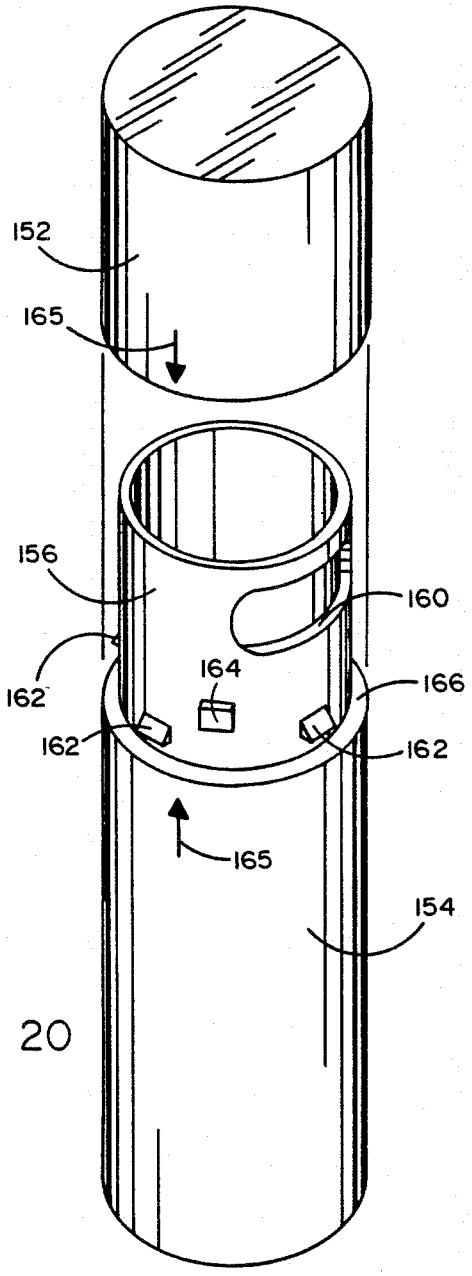
FIG. 20
FIG. 21
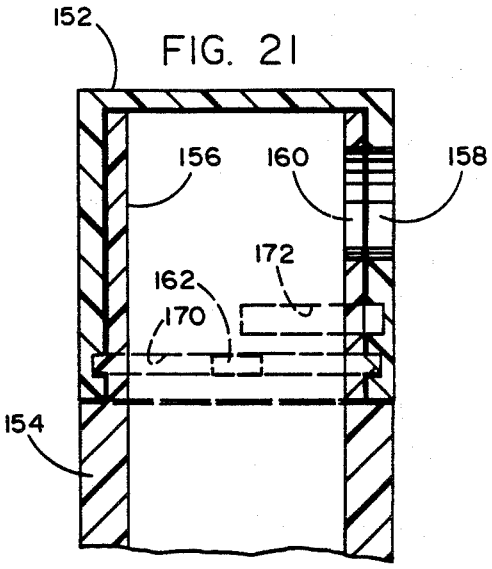
FIG. 22
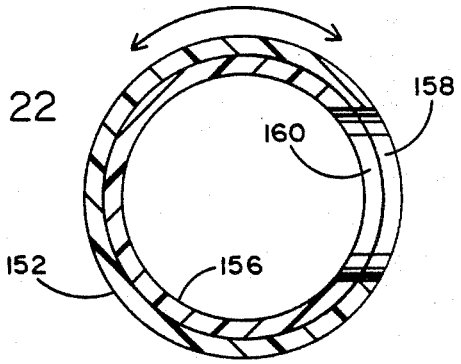

ARTICLE DISPENSER WITH TAMPER-EVIDENT MEANS

CROSS-REFERENCE TO RELATED APPLICATIONS

This application is a continuation-in-part of U.S. application Ser. No. 781,040 filed Sept. 27, 1985 now abandoned.

FIELD OF THE INVENTION

This invention relates to the art of containers and particularly, to the art of capless containers for use in dispensing medicine.

PRIOR ART

Containers which have caps for allowing an opening to be covered or uncovered are known in the art. These containers come in a variety of shapes and sizes and are used for a variety of materials. A body portion typically serves to contain the material being stored and also provides an opening such as a threaded neck for attaching a cap. Many of these containers are designed to be child-proof by providing caps which must be manipulated in a particular fashion in order to be removed. While many of these containers may be successful in preventing children from gaining access to the contents, they also prevent adults who may be arthritic or paralyzed or who, for some other reason have the use of only one hand, from opening the containers. Thus, these types of containers have limited usefulness since they cannot be used by adults unable to open them. One solution to this problem is disclosed in U.S. Pat. No. 4,522,313 issued on June 11, 1985 to the coinventors of the present invention. This patent discloses an article dispenser in which the articles are stored in a vessel having a sphere pivotally suspended from the vessel for rotation in only one direction about a singular axis that is offset from a second axis. The article within the container is conveyed from its stored location within the vessel into a cavity in the sphere and from the cavity to a location external to the vessel when the sphere is rotated. While the abovenoted invention of U.S. Pat. No. 4,522,313 provides an elegant solution to the aforementioned problem, alternative solutions which may be less expensive to manufacture or assemble or which involve a different type of motion by the user to gain access to the articles contained therein would be highly desirable to achieve.

A particularly important deficiency of the prior art is the lack of any substantially fool-proof tamper-evident indicator which would immediately put the user on notice that the contents of a pill container may have been tampered with after the container left the pill manufacturer.

SUMMARY OF THE INVENTION

The present invention comprises an article dispenser having a container or a container-mating portion and a dispenser control member, the former being in coaxial contiguous engagement with the latter for relative slideable motion therebetween. A flexible member, which may be made integral to either the container portion or the dispenser control member in alternative embodiments, provides positive locking control for opening and closing the dispenser and also provides means making a substantially permanent engagement between the container portion and the dispenser control member.

The present invention has particularly advantageous application in the pharmaceutical industry for containing and dispensing pills such as vitamin pills, prescription drug pills or other products which can be conveniently packaged in pill form. It will be seen hereinafter that one of the principal advantages of the present invention resides in its convenience of use for the purpose of dispensing such pills, while requiring the application of a nominal pressure for activation by the user to release a pill. Other advantages of the present invention relate to its simplicity and economy of structure. More specifically, the invention comprises only two separate units which are readily and easily integrated in an assembly process. Furthermore, each of these units is preferably made of a readily moldable plastic thereby enabling high volume and low-cost production minimizing the retail costs of the invention and rendering it readily available to the general public. Such a dispenser is particularly important to those who, for reasons of handicap or other reasons, would find it especially useful to be able to dispense a pill in such a simple and convenient manner without requiring the use of two hands. Of course, the latter advantage is not necessarily limited to handicapped individuals such as arthritic patients and the like who would find the dispenser of the present invention particularly advantageous for their particular limitations. The ease of dispensing articles by means of the present invention, which may be readily accomplished by the use of one hand, is also particularly beneficial to individuals who would otherwise ordinarily have the use of both hands but are in situations where it is not convenient to employ both hands. By way of example, an individual driving a vehicle who wishes to dispense a pill by means of the present invention, a pill which he or she must take at a particular time during driving, would find it particularly advantageous to use the present invention whereby it is not necessary to remove both hands from the steering wheel of the vehicle. Several different embodiments are disclosed and provide alternatives in the means for opening the dispenser for access to the articles therein as well as providing a choice between complete dispensers or portions thereof which mate with conventional containers.

A particularly novel and timely feature of the present invention is its tamper-evident configuration which, in effect, warns the user in the event that someone has gained access to the contents of the dispenser between the time it left the pharmaceutical company and the time it was purchased. This feature provides aligned indicia if and only if the user is the first to gain access to the dispenser contents. Accordingly, the present invention provides a secure, tamper-evident dispenser for use by manufacturers of over-the-counter products such as aspirin, vitamins and the like.

OBJECTS OF THE INVENTION

It is therefore a principal object of the present invention to provide an easy-open article dispenser of the type which may be advantageously used for dispensing pills such as vitamins and pharmaceuticals and which dispenser is readily activated by simply sliding one portion relative to another portion.

It is an additional of the present invention to provide an article dispenser of the type particularly adapted for dispensing pill-shaped articles such as vitamins and pharmaceuticals and the like and which is designed to be manufactured at low-cost using plastic molding processes and which is especially simple and easy to operate to dispense a pill or other solid article.

It is still an additional object of the present invention to provide a two-piece article dispenser having a container for housing a plurality of solid articles to be dispensed, and a dispenser control member which may be made to move in slideable engagement with the container for selectively releasing one article at a time.

It is still an additional object of the present invention to provide an easy-open article dispenser which may be readily adapted to mate with conventional pill-type containers for obviating the cap removal step associated with such conventional containers.

It is still an additional object of the present invention to provide a tamper-evident pill dispenser which warns the user of possible tampering of the contents at the time of purchase.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings:

FIG. 1 is an isometric view of a first embodiment of the invention shown in its open configuration;

FIG. 2 is an isometric view of the first embodiment of the invention shown in its closed configuration;

FIG. 3 is a cross-sectional view of the first embodiment taken along lines 3—3 of FIG. 1;

FIG. 4 is a cross-sectional view similar to that of FIG. 3 but corresponding to the closed configuration of FIG. 2;

FIG. 5 is an isometric view of the container portion of the embodiment of FIG. 1;

FIG. 6 is an isometric view of a second embodiment of the invention;

FIGS. 7 and 8 are cross-sectional views of the second embodiment taken along lines 7—7 and 8—8, respectively, of FIG. 6;

FIGS. 19 and 20 are isometric views of a sixth embodiment of the invention which provides a tamper-evident feature;

FIGS. 21 and 22 are cross-sectional views of the sixth embodiment taken along lines 21—21 and 22—22, respectively, of FIG. 19;

DETAILED DESCRIPTION OF A PREFERRED EMBODIMENT

Figure 9:
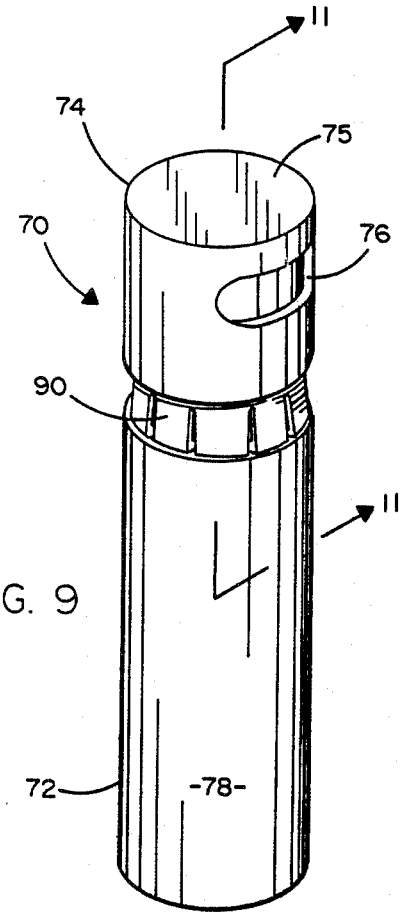
FIG. 9 is an isometric view of a third embodiment of the present invention shown in its closed configuration.
Figure 10:
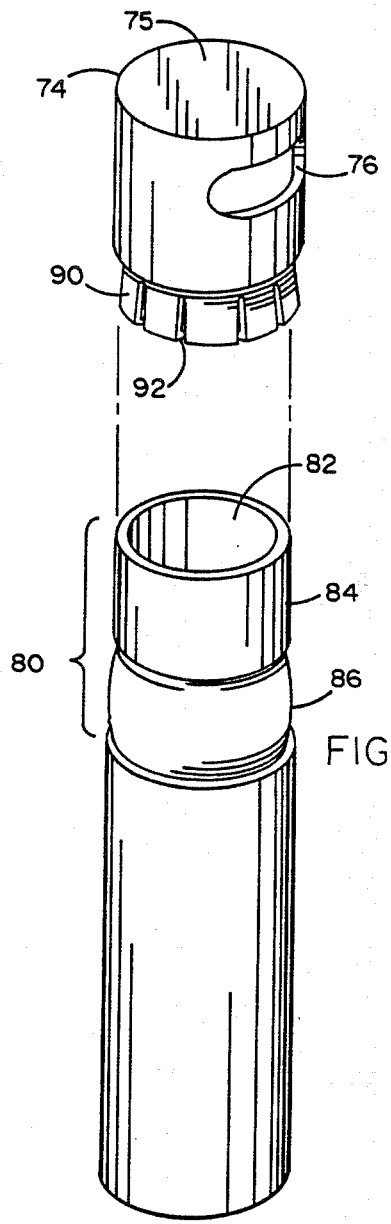
FIG. 10 is an exploded isometric view of the third embodiment.

Reference will first be made to FIGS. 1 through 5 which relate to a first embodiment of an article dispenser of the present invention. As seen in FIGS. 1 through 5, article dispenser 10 comprises a container portion 12 and a dispenser control member 14 as principal elements thereof. The dispenser control member 14 is characterized by a dispenser aperture 16 and a top surface 17. It will be seen hereinafter that the aperture 16 provides the exit through which articles contained within the first embodiment article dispenser 10 may be dispensed by the user. As seen further in FIGS. 1 through 5, container portion 12 comprises a chamber 18 adapted to house a plurality of selected articles such as pharmaceutical pills, vitamins and the like and is further characterized by having a dispenser portion 20 which as seen best in FIG. 5, comprises an access port 22, a ring 24, a neck 26 and an annular interface surface 28. In the particular embodiment illustrated in FIGS. 1 through 5, access port 22 provides access to chamber 18 as well as a part of the exit path that an article contained within chamber 18 takes to reach the dispenser aperture 16 as will be hereinafter more fully understood. Ring 24 in effect provides a closure member depending upon the slideable relationship between the container 12 and the dispenser control member 14. More specifically, when the container portion 12 and dispenser control member 14 are placed into the open configuration illustrated in FIG. 1, the ring 24 is below the dispenser aperture 16 thereby providing a direct path between access port 22 and the aperture 16 to permit articles to be dispensed. However, when the container portion 12 and dispenser control member 14 are compressed toward one another as illustrated in the configuration of FIG. 2, then the ring 24 is immediately adjacent the dispenser aperture 16 thereby in effect, closing the dispenser aperture 16 and preventing articles contained within chamber 18 from being dispensed. Neck 26 and annular interface 28 provide a suitable interconnection between ring 24 and chamber 18 but also provide a control surface between the container portion 12 and the dispenser control member 14 by means of flexible protrusions 30 which extend diagonally from the neck 26 adjacent the ring 24. As is seen in FIG. 5, the flexible protrusions 30 are spaced around the neck 26 in a substantially symmetrical manner and gaps 32 are provided between the flexible protrusions 30. Gaps 32 permit a substantial degree of bending of the flexible protrusions 30 in response to the frictional engagement therewith of the corresponding interior surfaces of dispenser control member 14 as will be hereinafter more fully described.

The detailed exterior and interior surfaces of the dispenser control member 14 may be best understood by referring to FIGS. 3 and 4 which illustrate the relationship between container portion 12 and dispenser control member 14 of the first embodiment 10 in the open and closed positions, respectively. It will be seen that the dispenser control member 14 comprises an exterior surface which is characterized by a first annular recess 34 and a second annular recess 36, the principal purposes of which are to provide the user with a readily graspable surface in order to apply the necessary frictional forces to open and close the article dispenser of the present invention. The lower-most portion of dispenser control member 14 is characterized by an annular flange 38 the purpose of which is to provide an upper limit of travel for the dispenser control member relative to the container portion whereby to prevent the user from inadvertently removing the dispenser control member after it has been placed upon the container portion for the first time. The interior surface of dispenser control member 14 is characterized by a first rise 40, a second rise 42, a peak 44 and a third rise 46 which act in combination to provide the necessary frictional engagement with the flexible protrusions 30 of the container portion 12 whereby to provide positive positions of open and closed for the article dispenser of FIGS. 1 and 2. These surfaces give the user a sense of fixed position and provide a degree of frictional resistance to the movement therebetween which may be readily varied depending upon the angular relationship between the protrusions 30 and the degree of extension of peak 44 towards the ring 24.

As seen best in FIGS. 3 and 4, the article dispenser 10 of FIGS. 1 through 5 is in its open position when the dispenser control member 14 is raised relative to container portion 12. This configuration places the dispenser aperture 16 above the access port 22 whereby an article contained within chamber 18 may be readily directed toward the upper-most portion of chamber 18 through the dispenser portion 20 of the container portion 12 and out of access port 22 and dispenser aperture 16 to the exterior of the article dispenser 10. Similarly, the article dispenser 10 is in its closed position when the dispenser control member 14 is compressed or positioned downwardly toward the container portion 12 until the access port 22 is adjacent the top 17 of the dispenser control member 14. In this configuration ring 24 is substantially blocking the dispenser aperture 16 and the top 17 is substantially blocking the access port 22 whereby it is not possible to release an article from the article dispenser 10. Furthermore, it will be seen that in this closed configuration the container portion 12 and dispenser control member 14 provide a substantially closed path for protection of the interiorly stored articles from the outside environment of the article dispenser. Furthermore, this path may be further secured in a closed position by the placement of a seal over the aperture 16 in a conventional manner.

A second embodiment of the article dispenser of the present invention is illustrated in FIGS. 6, 7 and 8. More specifically, as shown in FIGS. 7 and 8, a second embodiment 50 comprises a container portion 52 having a dispenser portion 53 and a dispenser control member 54 having a dispenser aperture 56. The container portion 52 provides a chamber 55 and the dispenser portion 53 of container portion 52 provides a second dispenser aperture 58 which is designed to be selectively aligned with the first dispenser aperture 56 of the dispenser control member 54. The second embodiment 50 of the present invention illustrated in FIGS. 6, 7 and 8 is similar in configuration to that of FIGS. 1 through 5 in that it also comprises a ring 60, a port 62, a plurality of flexible protrusions 64, an annular recess 66 and a annular flange 68, all of which provide the same functions as their corresponding analogous elements of FIGS. 1 through 5. The principal difference between the second embodiment 50 of the article dispenser and the first embodiment 10 illustrated in FIGS. 1 through 5, resides in the manner in which access to the contained articles is acquired. More specifically, the second embodiment of the article dispenser is designed for providing access to the articles contained within the chamber 55 by means of rotation of dispenser control member 54 relative to container portion 52 in order to align the first dispenser aperture 56 and a second dispenser aperture 58. There is no verticle motion or relative vertical motion between the container portion 52 and the dispenser control member 54 once the dispenser control member has been placed onto and secured to the container portion 52. The flexible protrusions 64 in this particular embodiment, provide with annular flange 68 a means for securing the dispenser control member 54 in a relatively fixed position in terms of vertical movement relative to container portion 52 after the dispenser control member is first placed on the container portion 52. Thereafter, the relative movement between the container portion and dispenser control member is confined to rotation whereby to provide access to the chamber 55 only when the first and second dispenser apertures 56 and 58, respectively, are aligned as illustrated in FIG. 8 and to provide a seal which prevents access to the articles within chamber 55 when the two apertures 56 and 58 are not aligned such as when they are facing opposite radial directions relative to the rotation axis of the second embodiment. In this particular configuration of course, the top 59 of the dispenser control member 54 is always adjacent the port 62 as the articles contained within chamber 55 are not designed to pass through port 62 after the container portion has been initially filled with the appropriate amount of articles and the dispenser control member is placed on the ontainer portion for the first time.

Figure 11:
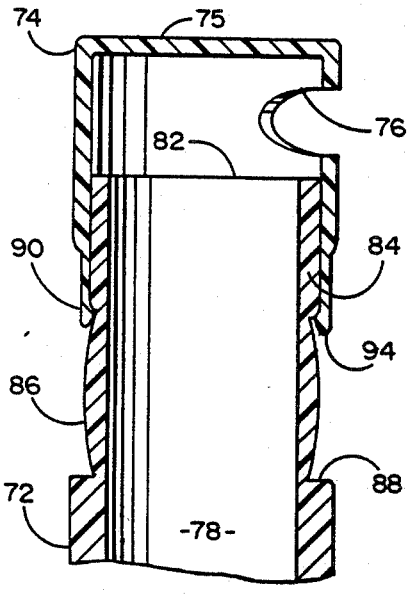
FIGS. 11 and 12 are cross-sectional views of the third embodiment taken along lines 11—11 of FIG. 9 and showing the invention in its open and closed configurations, respectively.
Figure 12:
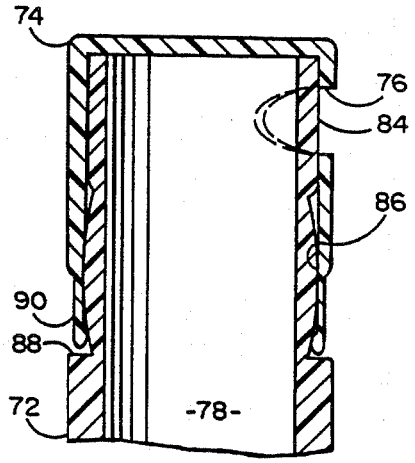
Figure 13:
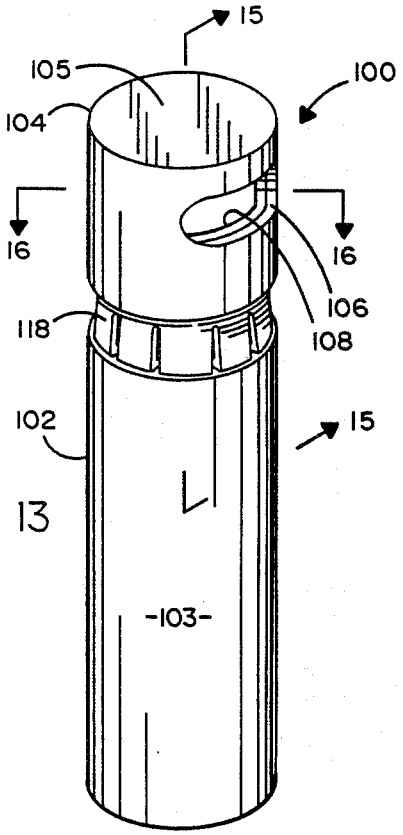
FIG. 13 is an isometric view of a fourth embodiment of the present invention shown in its closed configuration.
Figure 14:
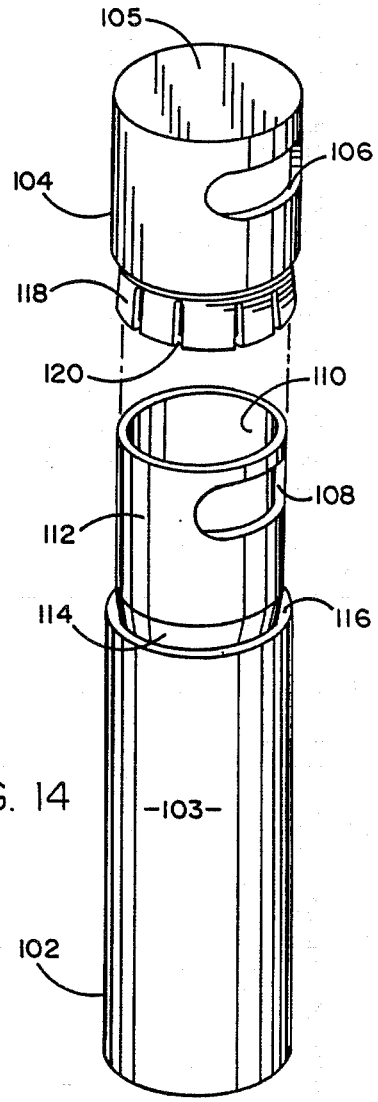
FIG. 14 is an exploded isometric view of the fourth embodiment.
Figure 15:
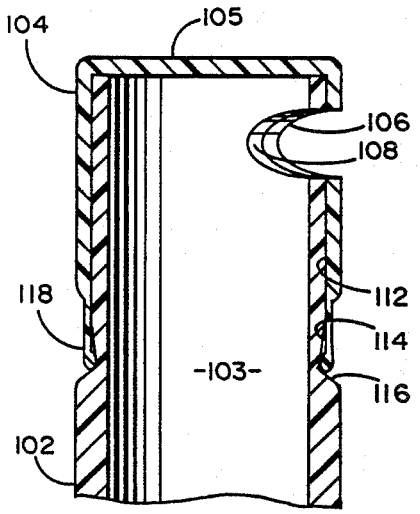
FIGS. 15 and 16 are cross-sectional views of the fourth embodiment taken along lines 15—15 and 16—16, respectively, of FIG. 13.
Figure 16:
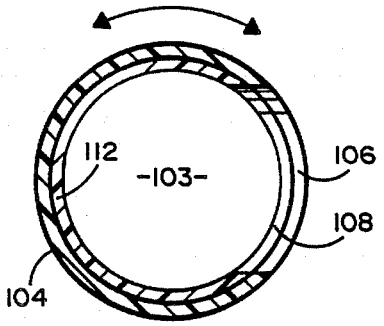

A third embodiment of the article dispenser of the present invention is illustrated in FIGS. 9 through 12. More specifically, as seen in FIGS. 9 through 12, a third embodiment 70 includes a container portion 72, a dispenser control member 74 as the principal elements thereof. The third embodiment 70 is designed to operate in a manner substantially identical to the first embodiment 10 of FIGS. 1 through 5 except for the structural relationship between the dispenser control member and the flexible protrusions. More specifically, unlike the previously described first embodiment of the invention 10 of FIGS. 1 through 5, in the third embodiment 70 of FIGS. 9 through 12, the dispenser control member 74 is designed to provide the flexible protrusions 90 which act on a curved wall ring 86 of the container portion 72. More specifically, as shown in FIGS. 9 through 12, container portion 72 comprises a chamber 78 contained within the lower-most portion of container portion 72 for receiving a plurality of articles. Chamber 78 is integrated with a dispenser portion 80 which comprises a straight walled ring 84 having an access port 82 and a curved wall ring 86 which interfaces the chamber 78 at a substantially perpendicular ridge 88. The flexible protrusions 90 of FIG. 9 are substantially identical in shape and purpose to those of FIG. 5 in that they are symmetrically positioned about the perimeter of the dispenser and are provided with a plurality of symmetrically spaced gaps 92 to permit the flexible protrusions to bend in response to the slideable engagement between the container portion 72 and the dispenser control member 74. Referring to FIGS. 11 and 12, it can be seen that in the open position of the dispenser 70 the dispenser control member 74 is displaced vertically upward with respect to the container portion 72 whereby the dispenser aperture 76 is raised above the straight wall ring 84 whereby an article may be dispensed from the chamber 78 through the access port 80 to and out of the dispenser aperture 76 to the exterior of the article dispenser 70. Furthermore, it will be seen particularly in FIG. 12 that the closed position of article dispenser 70 is obtained when the dispenser control member 74 is compressed relative to container portion 72 whereby the top 75 of the dispenser control member 74 is in engagement with the top of straight wall ring 84 and the ring 84 is substantially in sealing relation with the dispenser aperture 76 to prevent access to the articles contained within chamber 78. It will be noted that this embodiment also provides an annular flange 94, in this instance at the lower-most portion of the flexible protrusions 90 whereby to optionally create a permanent relationship between container portion 72 and dispenser control member 74 so that once placed on the container portion, the dispenser control member cannot be removed from the container portion.

A fourth embodiment of the invention is illustrated in FIGS. 13 through 16. This fourth embodiment 100 of the article dispenser of the present invention is similar in respect to operation to the second embodiment 50 of FIGS. 6, 7 and 8 in that the container portion and dispenser control member 102 and 104, respectively, rotate with respect to one another to gain access to an interior chamber 103 where the articles may be stored for dispensing. However, embodiment 100 utilizes a structure substantially similar to the third embodiment 70 of FIGS. 9 through 12. More specifically, the fourth embodiment 100 comprises a container portion 102 and a dispenser control member 104. The dispenser control member provides an aperture 106 and the container portion comprises a dispenser aperture 108 as well as a port 110, a ring 112, and a neck 114 which interfaces the chamber 103 by means of a perpendicular ridge 116. The dispenser control member provides a plurality of flexible protrusions 118 spaced symmetrically around its periphery and is also characterized by a plurality of gaps between the flexible protrusions to provide the spring-like action previously described. As previously described in conjunction with the second embodiment 50, the fourth embodiment is designed to provide access to the chamber only when the apertures 106 and 108 are aligned or substantially aligned and to seal the chamber from the exterior when the apertures 106 and 108 are not substantially aligned such as when the apertures are oriented to face in opposite radial directions from the axis of the chamber 103. Port 110 is permanently positioned adjacent the top 105 of dispenser control member 104 whereby the position of the two apertures 106 and 108 provide the only access to the interior of the article dispenser 70.

Figure 17:
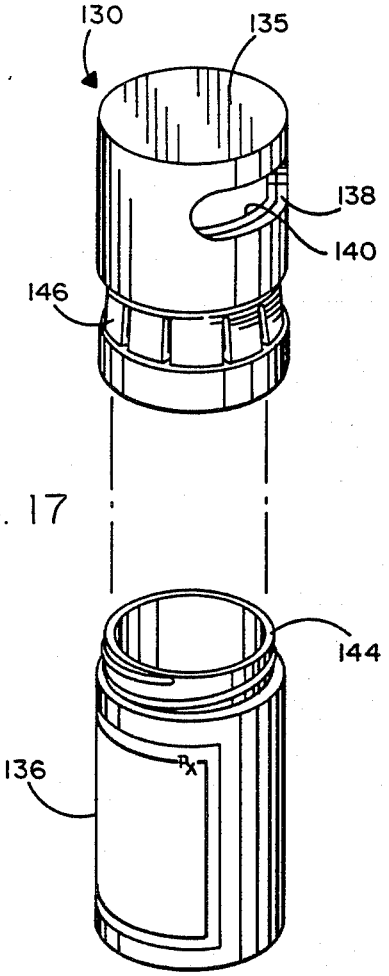
FIGS. 17 and 18 are isometric views of a fifth embodiment of the invention.
Figure 18:
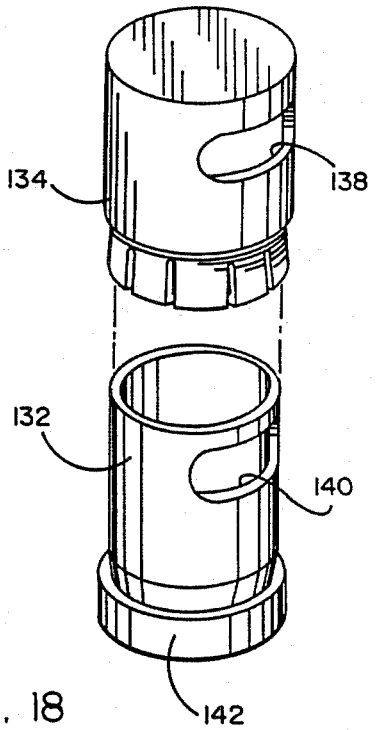

All of the previously described embodiments of the article dispenser of the present invention may be adapted to operate in conjunction with a separate container instead of the integral container previously described. By way of example, a fifth embodiment of the article dispenser is illustrated in FIGS. 17 and 18. This fifth embodiment 130 comprises a container adapter 132 and a dispenser control member 134. The adapter 132 is designed to connect to a separate conventional container 136 either by means of a threaded engagement as shown in FIG. 17 or a snap-on engagement (not shown). The particular configuration of the fifth embodiment illustrated in FIGS. 17 and 18 is adapted from the fourth embodiment 100 wherein access to the interior of the container 136 is provided by aligning a first dispenser aperture 138 in the dispenser control member 134 with a second dispenser aperture 140 in the container adapter 132. An adapter ring 142 is provided in the container adapter 132 and is provided with a threaded neck which is designed to mate with the corresponding threaded neck 144 of container 136. The dispenser control member 134 is provided with a plurality of flexible protrusions 146 and an enclosing top surface 135 to permit it to operate in a substantially identical manner to that of the fourth embodiment 100 of FIGS. 13 through 16.

Reference will now be made to FIGS. 19–28 which illustrate an additional embodiment of the invention in which a tamper-evident feature is provided. More specifically, referring to FIGS. 19 and 20 it will be seen that the tamper-evident embodiment 150 comprises a dispenser control member 152 and a container member 154 having a dispenser portion 156. Members 152 and 154 comprise apertures 158 and 160, respectively, which when aligned as shown in FIG. 19, provide access to the contents of dispenser 150. Member 152 is retained in rotational engagement with the dispenser portion 156 by a plurality of protrusions 162 spaced symmetrically about dispenser portion 156 above a shoulder 166. An additional protrusion 164, also retains the dispenser control member 152 on the container member 154, but serves the primary purpose of the tamper-evident feature hereinafter described.

Figure 23:
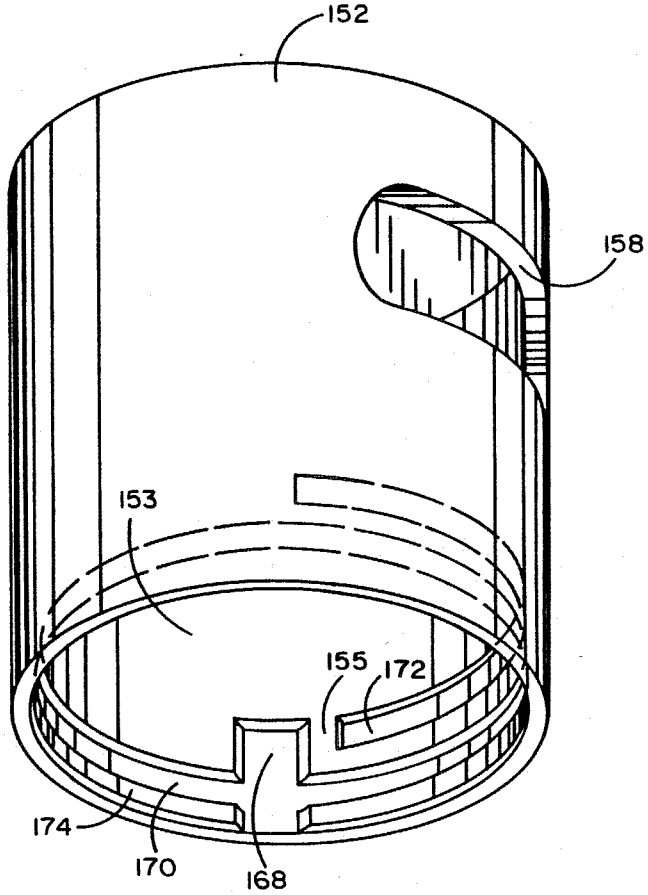
FIG. 23 is an enlarged isometric view of the dispenser control portion of the embodiment of FIGS. 19 and 20.

Referring now to FIG. 23, it will be seen that the interior surface 153 of dispenser control member 152 is provided with a vertical slot 168, a locking groove 170, a turning groove 172 and an annular ridge 174. Groove 170 extends around the full perimeter of the interior surface 153, broken only by slot 168. Groove 172 extends less than 180 degrees along the interior surface 153 and is separated from slot 168 by a bridge 155.

Figure 26:
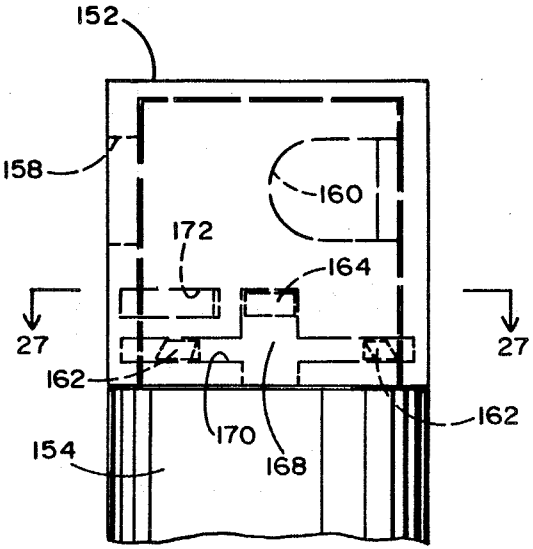
FIG. 26 is a schematic illustration of the tamper-evident feature of the sixth embodiment.

When dispenser control member 152 is placed onto the dispenser portion 156 of container member 154, protrusions 162 slide over ridge 174 and permanently lock into groove 170. Each protrusion 162 is provided with a tapered upper surface and a non-tapered lower surface to facilitate this placement and locking. Concurrently, protrusion 164 must be aligned with and engages slot 168. The relationship between protrusion 164 and slot 168 is shown in FIG. 26 which represents the configuration of the tamper-evident embodiment 150 when the member 152 is initially placed onto member 154.

Figure 27:
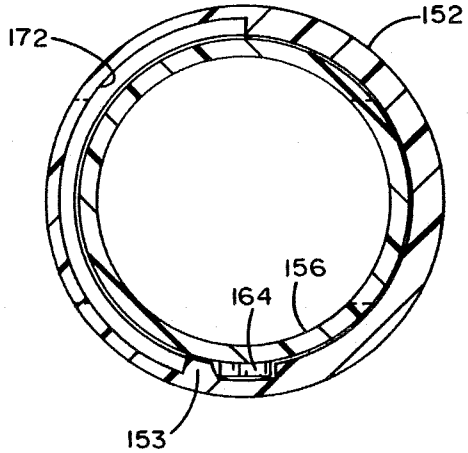
FIGS. 27 and 28 are cross-sectional views taken along lines 27—27 of FIG. 26 and illustrating the transition from the tamper-evident configuration to the normal open and close configuration of the sixth embodiment of the invention.
Figure 28:
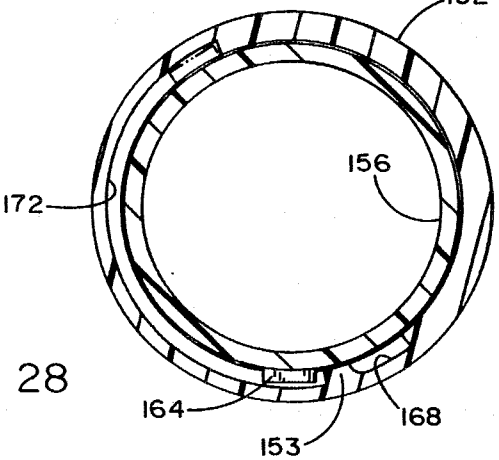

In this initial placement configuration, two key elements of the invention are noteworthy. One such key element is the alignment of two indicia such as alignment indicia 165 shown in FIG. 20. Another is the non-overlapping positions of apertures 158 and 160. In this configuration, which corresponds to the purchase configuration, there is only one way to gain access to the contents of dispenser 150 and that is to twist or rotate member 152 relative to member 154 until apertures 158 and 160 are aligned or at least substantially overlapping. Member 152 cannot be removed from member 154 because of the locking relationship between protrusions 162 and locking groove 170. However, in order to twist or rotate member 152 to gain access to the contents, protrusion 164 must transfer from slot 168 to groove 172. This transfer action is represented in FIGS. 27 and 28. In FIG. 27, protrusion 164 is shown in slot 168 and in FIG. 28 protrusion 164 is shown on the other side of bridge 153 in groove 172. The bridge side of slot 168 is contoured to facilitate this transfer, however the bridge side of slot 172 is not contoured thereby preventing an oppositely directed rotational force from allowing protrusion 164 to be retransferred back to slot 168.

Accordingly, once the member 152 is twisted or rotated in the manner shown in FIGS. 27 and 28, protrusion 164 resides in groove 172 thereby enabling continued rotation of member 152 until apertures 158 and 160 are aligned for dispensing articles within container member 154. Normal open and close operation of the invention can then be effected in the manner described above for the embodiment of FIG. 13 for example. More importantly however, is that once the member 152 is rotated to the configuration of FIG. 28, indicia 165 can no longer be aligned. Therefore, if a purchaser finds that the dispenser indicia are not aligned at the time of purchase, there is reason to question whether the contents thereof may have been tampered with. On the other hand, if the purchaser finds that the dispenser indicia are aligned at the time of purchase, there is reason to be confident that no tampering with the contents could possibly have taken place after the control member 152 was first placed onto the container member 154.

Figure 25:
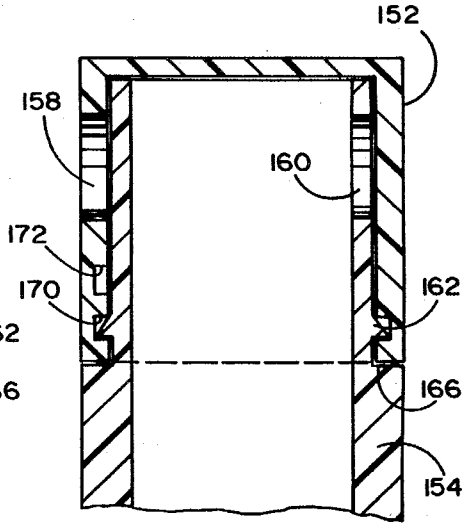
FIGS. 24 and 25 are cross-sectional views of the sixth embodiment illustrating the permanent closure thereof after initial filling.
Figure 24:
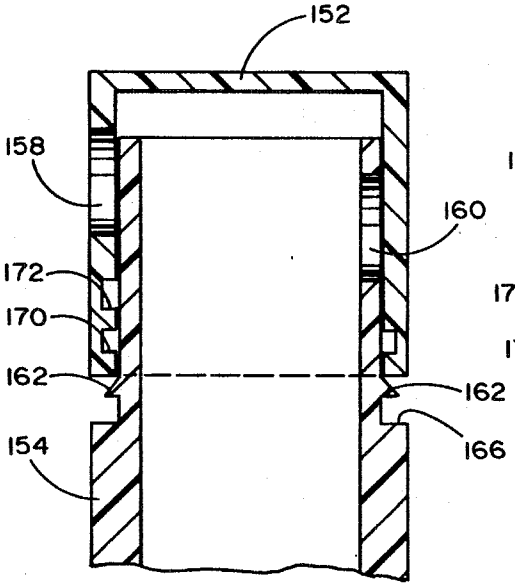

FIGS. 21 and 22 illustrate the dispenser configuration during normal open and close operation and FIGS. 24 and 25 illustrate the dispenser configuration during and after initial placement of member 152 onto member 154, respectively.

It will now be understood that the present invention comprises an article dispenser having a container or container mating portion and a dispenser control member, the former being in coaxial contiguous engagement with the latter for relative slideable motion therebetween. Several embodiments have been disclosed in which the slideable motion is in a vertical direction substantially parallel to the axis of the container and several embodiments have been disclosed in which the slideable motion is one of rotation about the axis of the container. Each of the embodiments is characterized by a flexible member which may be made integral to either the container portion or the dispenser control member and provides positive locking control for opening and closing the dispenser and provides means for making a substantially permanent engagement between the container portion and the dispenser control member. The resultant configurations provide an article dispenser for containing a plurality of articles such as pharmaceutical pills, vitamins and the like, access to which may be gained by positioning of the dispenser control member relative to the container portion without having a removable cap therefrom. All of the various embodiments disclosed herein may be readily made from conventional plastics using low-cost manufacturing techniques such as well-known conventional plastic molding processes. In all cases the result is a dispenser which is especially useful to people who have handicaps or who otherwise have difficulty in opening more conventional prior art article containers which are primarily adapted for resistance to inadvertent opening by children. However, this advantage is not necessarily limited to handicapped individuals but may be enjoyed by all individuals who would otherwise ordinarily have difficulty with prior art containers or would otherwise be disposed to use a container with the ease of opening characteristics of the present invention. An especially timely and important tamper-evident feature of the invention has been disclosed. This feature permits easily visual confirmation by the ultimate purchaser that the contained articles have not been tampered with after the dispenser was filled.

Those having skill in the art to which the present invention pertains will now, as a result of the teaching herein disclosed, perceive various modifications and additions such as alternative geometries, dimensions and materials which may be utilized instead of those specifically described herein. However, it will be understood that the particular embodiments described herein are presented by way of exemplary illustration only, that the invention contemplates all such modifications and additions and that the scope of the invention is to be limited only by the claims appended hereto.

I claim:

1. A pill dispenser for containing and dispensing pills such as aspirin, vitamins, and the like, the dispenser comprising:

a container member having a compartment for containing said pills, said compartment communicating with a dispenser portion having a first aperture;

a dispenser control member having a second aperture and positioned relative to said dispenser portion of said container member for providing access to said pills only when said first and second apertures are substantially aligned;

means preventing removal of said dispenser control member from said container member after initial relative positioning thereof;

means indicating whether or not said first and second apertures may have been previously aligned;

said indicating means comprising at least one twist-limiting protrusion on said dispenser portion, a slot, a bridge and a second locking groove on said dispenser control member, said bridge separating said slot from said second locking groove, said slot receiving said twist-limiting protrusion upon placement of said dispenser control member on said dispenser portion and said bridge permitting only unidirectional travel of said twist-limiting protrusion from said slot into said second locking groove upon rotation of said dispenser control member whereby the initial position of said twist-limiting protrusion is indicative of whether or not said pill dispenser has been tampered with previously; and wherein said removal preventing means comprises at least one non-removable locking protrusion on said dispenser portion and a first locking groove on said dispenser control member for receiving said protrusion in slideable engagement whereby said locking protrusion, once within said first locking groove, cannot be removed therefrom.

* * * * *